US010683063B2

(12) United States Patent
Stephan

(10) Patent No.: US 10,683,063 B2
(45) Date of Patent: Jun. 16, 2020

(54) MODULAR COMPONENT WAKEBOARD BINDING

(71) Applicant: Scott Stephan, Seattle, WA (US)

(72) Inventor: Scott Stephan, Seattle, WA (US)

( * ) Notice: Subject to any disclaimer, the term of this patent is extended or adjusted under 35 U.S.C. 154(b) by 0 days.

(21) Appl. No.: 14/501,428

(22) Filed: Sep. 30, 2014

(65) Prior Publication Data

US 2015/0093949 A1 Apr. 2, 2015

Related U.S. Application Data

(60) Provisional application No. 61/884,410, filed on Sep. 30, 2013.

(51) Int. Cl.

| | |
|---|---|
| ***B63B 35/81*** | (2006.01) |
| ***B63B 32/30*** | (2020.01) |
| *B63B 32/20* | (2020.01) |
| *B63B 32/40* | (2020.01) |

(52) U.S. Cl.

CPC ..... *B63B 32/35* (2020.02); *B63B 32/20* (2020.02); *B63B 32/40* (2020.02); *B63B 32/45* (2020.02); *Y10T 29/49947* (2015.01)

(58) Field of Classification Search

CPC ..... B63B 35/812; B63B 35/7936; B63B 2035/818; A63C 10/00

USPC ..... D21/764

See application file for complete search history.

(56) References Cited

U.S. PATENT DOCUMENTS

| | | | | |
|---|---|---|---|---|
| 4,869,697 | A * | 9/1989 | Ackert | B63B 35/812 24/134 R |
| 4,871,337 | A * | 10/1989 | Harris | A63C 5/003 280/14.24 |
| 5,277,635 | A | 1/1994 | Gillis | |
| 5,624,291 | A | 4/1997 | McClaskey | |
| 5,868,594 | A | 2/1999 | Vukelic et al. | |
| 5,910,034 | A | 6/1999 | Vukelic et al. | |
| 6,124,010 | A * | 9/2000 | Shih | A41D 27/24 428/60 |
| 6,174,212 | B1 * | 1/2001 | Chang | B63B 35/812 280/607 |
| 7,134,928 | B1 * | 11/2006 | Cannon | A63C 10/04 441/70 |
| 7,766,711 | B2 | 8/2010 | Crumrine | |
| 2004/0201203 | A1 * | 10/2004 | Karol | A43B 5/0401 280/618 |
| 2005/0285373 | A1 * | 12/2005 | Miller | A63C 10/10 280/623 |
| 2008/0122202 | A1 * | 5/2008 | Furr | A63C 10/12 280/626 |
| 2013/0113184 | A1 * | 5/2013 | Pelchat | A63C 10/16 280/607 |
| 2015/0104987 | A1 * | 4/2015 | Shupe | B63B 35/812 441/70 |

* cited by examiner

*Primary Examiner* — Andrew Polay

(74) *Attorney, Agent, or Firm* — Foster Swift Collins & Smith, P.C.; Zachary W. Behler

(57) ABSTRACT

A wakeboard binding assembly in which the upper may be directly connected to the base plate without additional adhesives, stitching, or fasteners thus facilitating the assembly, removal, modification or interchange of one or more components of the binding during manufacturing, by a consumer or dealer to customize the fit, function and/or aesthetics of the binding.

16 Claims, 6 Drawing Sheets

MODULAR COMPONENT WAKEBOARD BINDING

CROSS REFERENCE TO RELATED APPLICATION

This application claims priority to U.S. provisional application Ser. No. 61/884,410, entitled "Modular Component Wakeboard Binding," filed Sep. 30, 2013.

FIELD OF INVENTION

The present invention is directed to a wakeboard binding and particularly to a wakeboard binding assembly in which the upper may be directly connected to the base plate without additional adhesives, stitching, or fasteners thus facilitating the assembly, removal, modification or interchange of one or more components of the binding during manufacturing, by a consumer or dealer to customize the fit, function and/or aesthetics of the binding.

BACKGROUND

Typically, the components of bindings used for wakeboards are permanently affixed to each other in a manner that makes modification of the binding after initial assembly difficult. Sometimes the upper of the binding is stitched together with a binding base as in U.S. Pat. No. 7,766,711 to Crumrine et al. Other times the binding components are attached using adhesives or cumbersome hardware. As a result, after manufacture, current wakeboard bindings are limited in configuration. However, a binding that is customizable to a broad range of riding configurations based on variation in material strength, stiffness, weight, density, color, etc. would be advantageous. Current connection methods such as stitching, adhesives, or hardware used to fasten an upper to a base plate are also slow, labor intensive, and complicate the replacement of broken parts. Thus, a need exists to provide improved binding assembly that can be easily adapted to be used for a multitude of riding styles and fit preferences.

The present invention solves this need by providing a wakeboard binding in which an upper may be directly connected to a base plate without additional adhesives, stitching, or fasteners. Such a configuration allows for one or more components to be removed, modified or interchanged by a consumer or dealer in order to customize the fit, function and/or aesthetics of the binding. Additionally, the simplified assembly procedure enables a person at a basic skill level to be able to deconstruct and rebuild a complete boot without degrading the integrity of any of the binding parts.

SUMMARY

The present invention is a wakeboard binding assembly in which an upper can be directly connected to a base plate without additional adhesives, stitching, or fasteners. Such a configuration allows for one or more components to be assembled, removed, modified or interchanged by a consumer or dealer in order to customize the fit, function and/or aesthetics of the binding. This customization offers the user a broad range of riding configurations based on the chosen variation in material strength, stiffness, weight, density, color, etc. used for each respective component. Weight distribution within the binding can be directed into the components that require the most structural integrity. The invention also allows worn or defective components to easily be replaced without replacing the entire binding assembly. The binding assembly can be adapted to be used for a multitude of riding styles and fit preferences. The reconfiguration of the hardware is also beneficial for localizing performance aspects of the binding into individualized sections. Additionally, the simplified assembly procedure enables a person at a basic skill level to be able to deconstruct and rebuild a complete boot.

BRIEF DESCRIPTION OF DRAWINGS

Various other aspects and advantages of the invention will become apparent in connection with the accompanying drawings wherein.

DESCRIPTION

The following description is presented to enable any person skilled in the art to make and/or use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Figure 1:
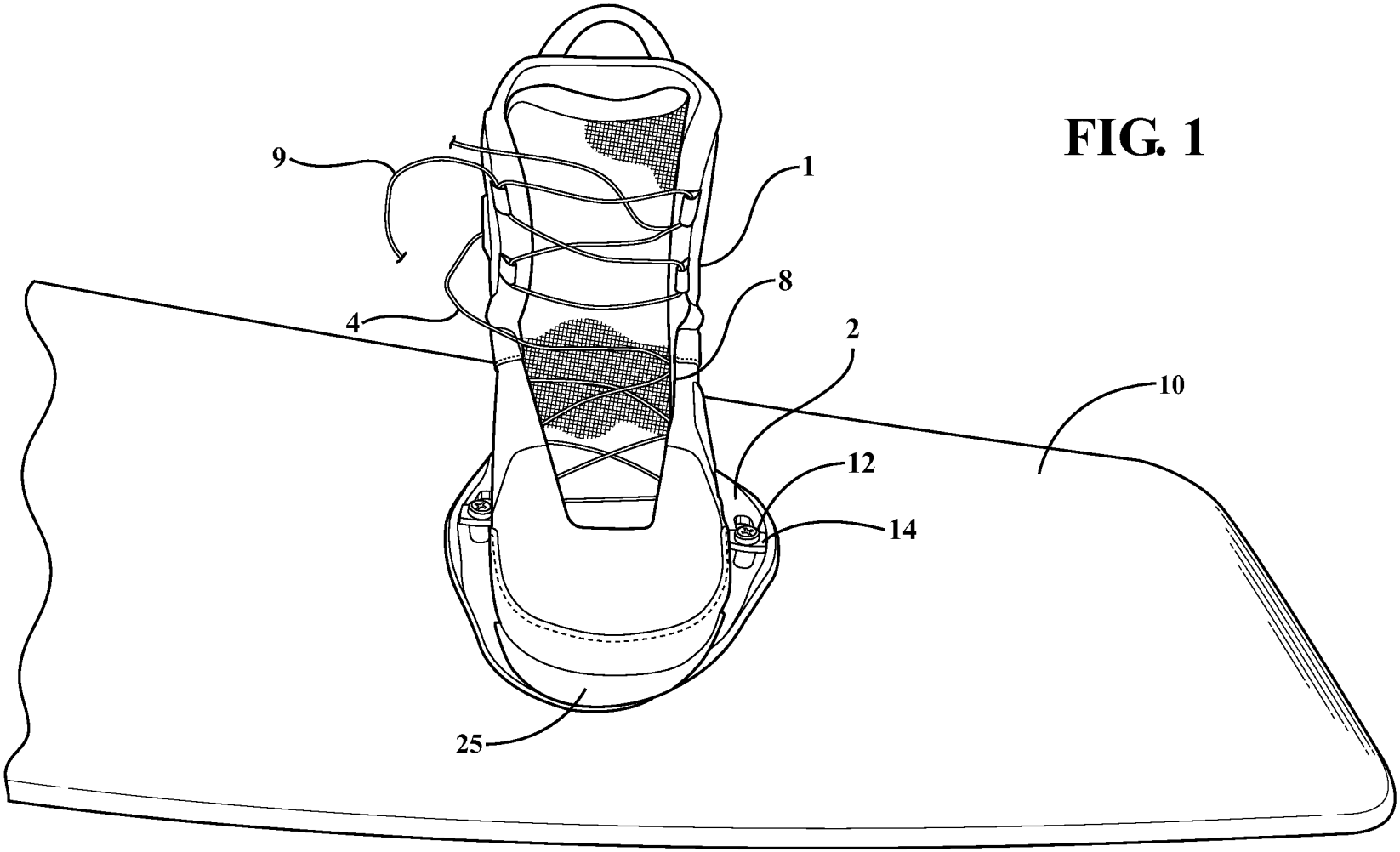
FIG. 1 is a view of an assembled inventive wakeboard binding mounted to a board.

FIG. 1 shows an embodiment of an assembled inventive wakeboard binding 9. As depicted in FIG. 1, the Applicant's invention includes an upper 1 and a base plate 2 that may be directly connected without additional adhesives, stitching, or fasteners. It should be understood that the upper 1 is a binding component that is intended to form an upper part of the binding that surrounds at least a portion of the user's foot. Examples of uppers 1 include toe pieces, heel pieces, overlays, one piece boots, underlays, combinations thereof, and the like. The upper 1 can be made of any material suitable for constructing a wakeboard binding. Typically, these materials include, canvass, synthetic leather, neoprene, nylon, rubber, synthetic materials, etc. In the preferred embodiment, the upper 1 includes a mechanism to form the upper to the user's foot 3. Any known tightening mechanism 3 could be utilized for this purpose such as lases, buckles, straps, hooks and loop fasteners, ratchets, etc. In the preferred embodiment, the mechanism to form the upper to the user's foot 3 includes laces located above the user's forefoot and in front of the user's ankle. However, the mechanism 3 could be placed in other locations in the upper suitable for forming the upper to the user's foot.

Figure 2:
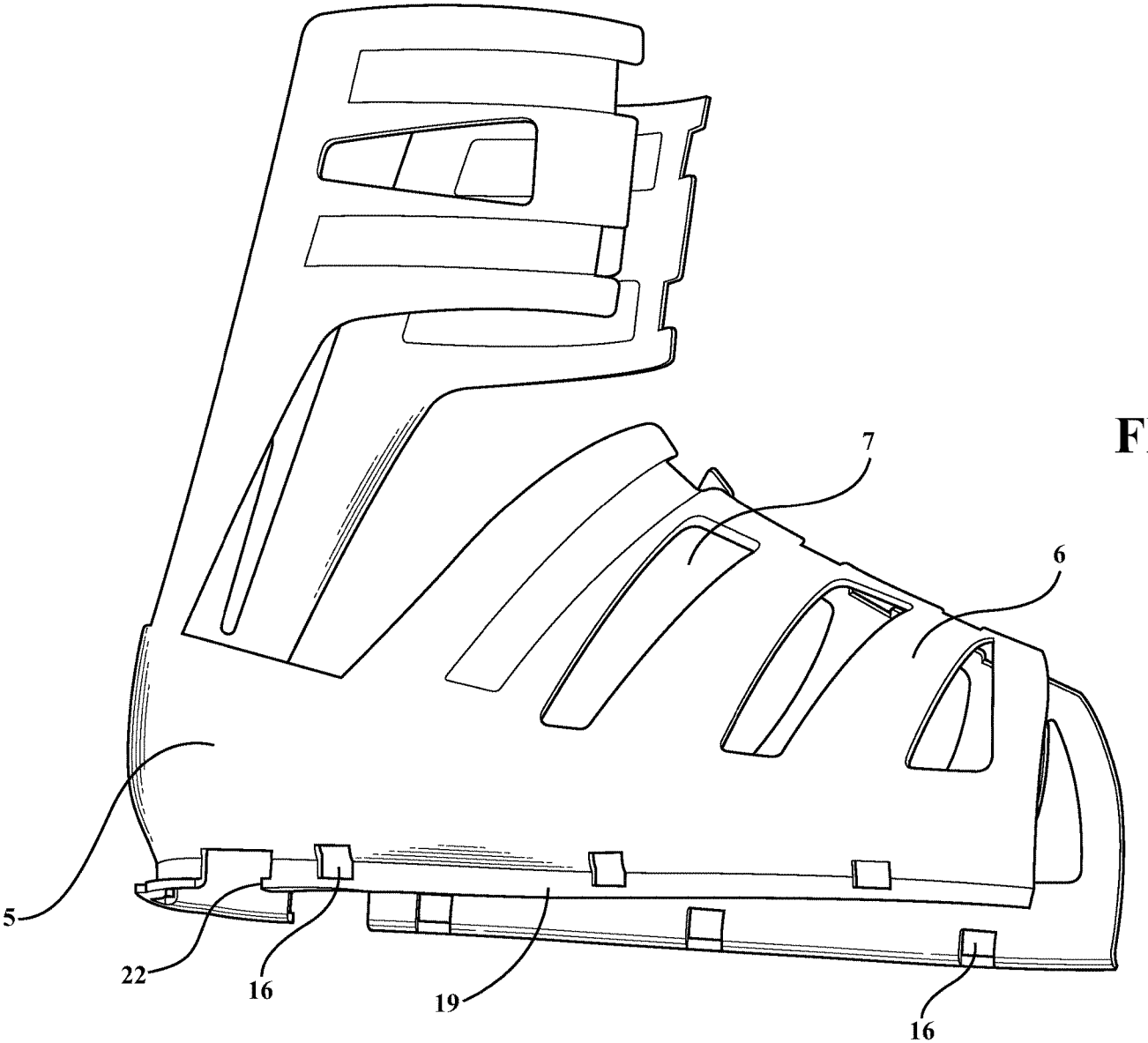
FIG. 2 is a view of the skeleton frame portion of the upper.

FIG. 2 shows the skeleton frame portion 5 of the upper 1. The skeleton frame 5 is a component of the upper 1 that facilitates the connection between the upper 1 and the base plate 2. The skeleton frame 5 can be a single structure or multiple structures integrated into the upper 1. The skeleton frame 5 is preferably constructed using a semi-rigid material, such as fiberglass, nylon, plastic, composite, etc. In the preferred embodiment, the skeleton frame 5 is configured to fit over the user's forefoot and around the user's ankle. The portions of skeleton frame 5 used to integrate the skeleton frame into the upper 6 are typically of semi-rigid construction. Holes 7 may be inserted into portions of the skeleton frame 5 that do not facilitate the connection with the upper 1 to reduce weight and increase flexibility. Any known fastening mechanism 8 could be utilized to integrate the skeleton frame 5 into the upper 1 such as stitching, adhesives, rivets, etc. In the preferred embodiment, the solid portions of the skeleton frame 5 are stitched together with at least one other component of the upper 1. See FIG. 1. In the preferred embodiment, the eyelets for the laces are stitched into the upper 1 so that the force of the laces pulls on the skeleton frame 5 and not on the textile portion of the upper 1. Adhesives may also be used to insure the integrity of the connections between the components of the upper 1.

Figure 3:
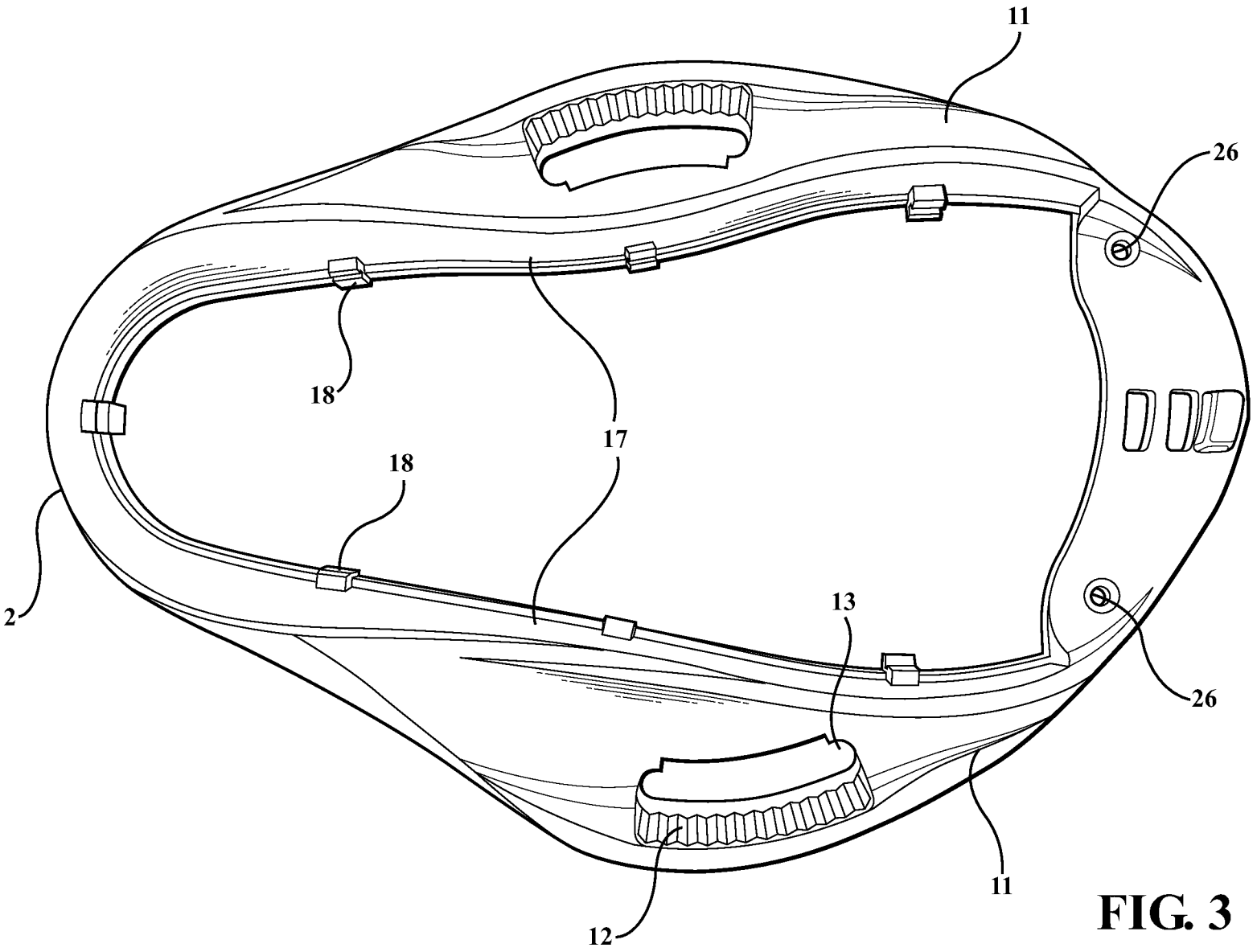
FIG. 3 is a top view of the base plate.

FIG. 3 shows a top view of the base plate 2 before it is connected to the upper 1. The base plate 2 is a structure that facilitates the connection between the binding 9 and the wakeboard 10. The base plate 2 can be made using a variety of materials suitable to meet weight, strength and cost constraints. In the preferred embodiment, the base plate 2 is constructed of fiberglass filled nylon. The base plate 2 has two connection flanges 11 that are used to connect the base plate 2 to the wakeboard 10. These connection flanges 11 may be located outside of the instep, or the side of the foot facing the midline of the user's body excluding the toes and heel, and outstep, or the side of the foot facing away from the midline of the user's body excluding the toes and heel, when the binding 9 is in use. Alternatively, the connection flanges 11 could be placed on the inside of binding plate 2 for a board 10 with different mounting configurations or layouts. The connection of these flanges 11 to the wakeboard 10 can be accomplished by any means that is sufficient to insure a solid connection between the base plate and the wakeboard while the binding is in use 12, such as thumb screws, bolts, clamps, and the like. In the preferred embodiment, each connection flange 11 is equipped with a channel 13 adapted to receive a washer assembly 14. A fastener 15 is then inserted into the washer assembly 14 to connect with the wakeboard 10. See FIG. 1.

Figure 4:
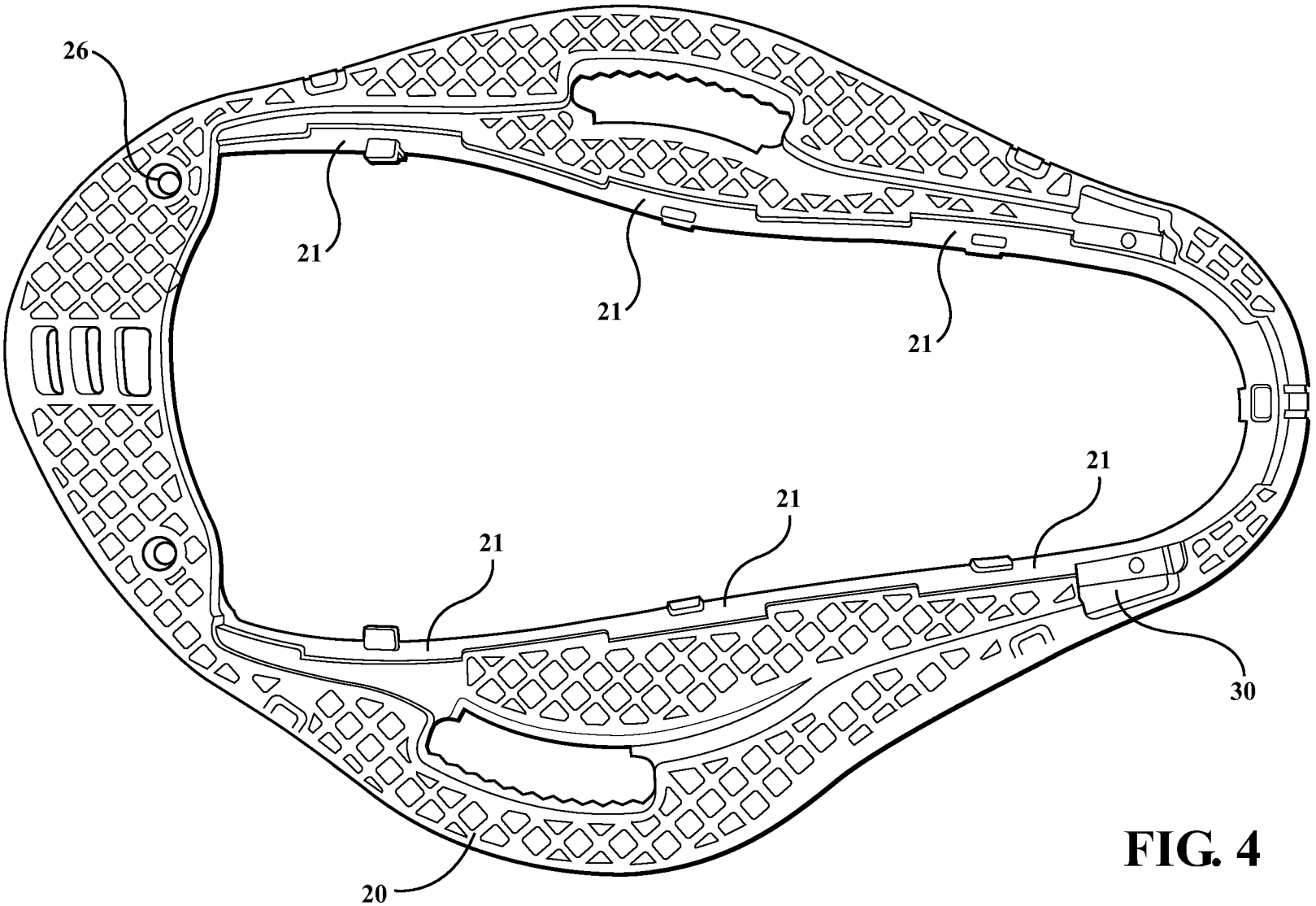
FIG. 4 is a bottom view of the base plate.

The upper 1 may be directly connected to the base plate 2 without additional adhesives, stitching, or fasteners. To facilitate this connection the portions of the skeleton frame 5 are configured to interlock with the base plate 2. This may be accomplished using eyelets, posts, pins, pegs, channels, hooks, tongues, grooves, snaps, latches, a combination thereof or any other known interlocking system suitable for creating a secure connection between the upper 1 and the base plate 2. In the preferred embodiment, a plurality of eyelets 16 is positioned around the lower periphery of the skeleton frame 5. In the preferred embodiment, eyelets 16 are placed along the instep, along the outstep, and in the heel portion of the skeleton frame 5. The base plate 2 is also fitted with a wall 17 that surrounds the heel and midstep of the user's foot. This wall 17 includes a plurality of attachment pegs 18 which facilitate the connection between the base plate 2 and the eyelets 16 in the skeleton frame 5. The eyelets 16 are positioned generally planar to the connection flanges 11 and shaped to receive corresponding attachment pegs 18 that are similarly oriented in the base plate wall 17. The skeleton frame 5 also may be constructed with a tongue 19 which is shaped to hook underneath a portion of the base plate 2. FIG. 4 shows the bottom 20 of the base plate 2. The base plate 2 may be configured with a groove 21 on the bottom 20 of the base plate 2 which accepts the vertical portion of the tongue 22. This configuration allows the skeleton frame 5 to snap into the base plate 2 creating a secure connection.

Figure 5:
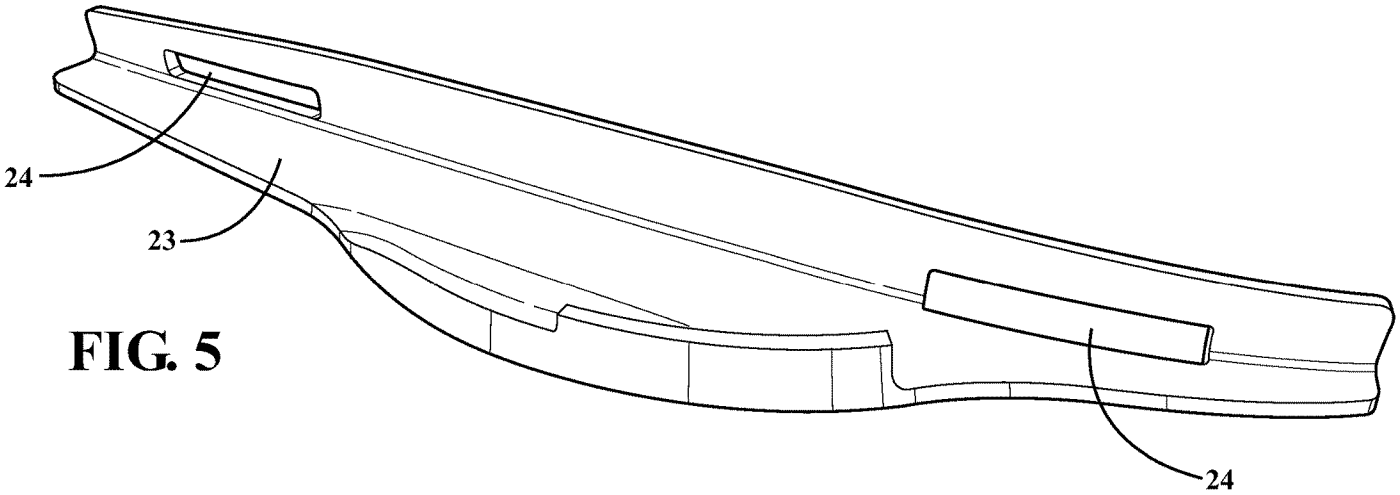
FIG. 5 is a side view of a lock beam used in a preferred embodiment of the binding.
Figure 6:
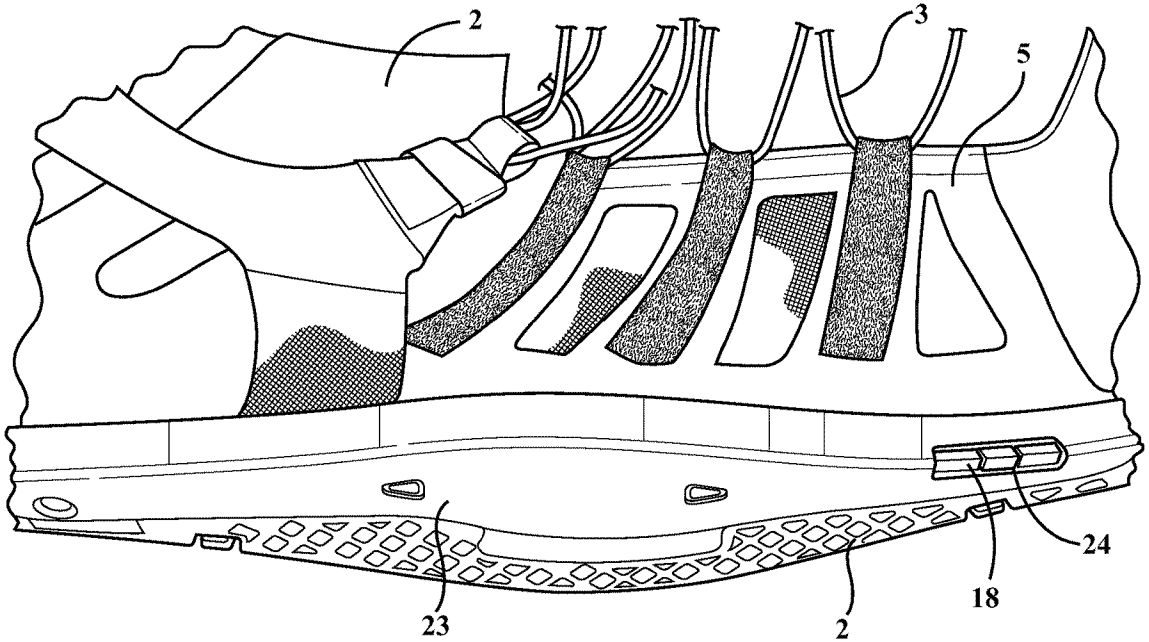
FIG. 6 is a perspective view of the interior instep view of the binding.

Optionally, the base plate 2 may be configured with one or more lock beams 23 that facilitate the connection between the upper 1 and the base plate 2. FIG. 5 shows a lock beam 23 used in a preferred embodiment of the binding 9. FIG. 6 shows a close up of the bottom 20 of the base plate 2 with a lock beam 23 installed. A lock beam 23 may be equipped with grooves 24 that are configured to receive attachment pegs 18 on the skeleton frame 5 and base plate 2. A lock beam 23 may be shaped in a variety of ways. When incorporated into the binding 9, a lock beam 23 snaps to the base plate 2 in such a way that it sandwiches a portion of the skeleton frame 5 between the lock beam 23 and the base plate 2. The lock beam 23 can be further secured to the base plate 2 using screws or similar fasteners. In the preferred embodiment, lock beams 23 are positioned along both the instep and outstep of the base plate 2. In the preferred embodiment, the lock beams 23 are designed as multipurpose components creating a tether between the upper 1 and the base plate 2, as well as a structure intended to keep the base plate 2 rigid from heel to toe.

The upper 1 may optionally incorporate a toe cap 25 that further facilitates the connection between the upper 1 and the base plate 2. Toe caps 25 are known in the art and are generally designed to enhance the durability and esthetics of the toe portion of the upper 1. Some embodiments of the inventive wakeboard binding 9 may incorporate a toe cap that is snapped to the base plate 2. The toe cap 25 can be further secured to the base plate 2 using screws inserted through holes 26 in the base plate 2 or similar fasteners.

Figure 7:
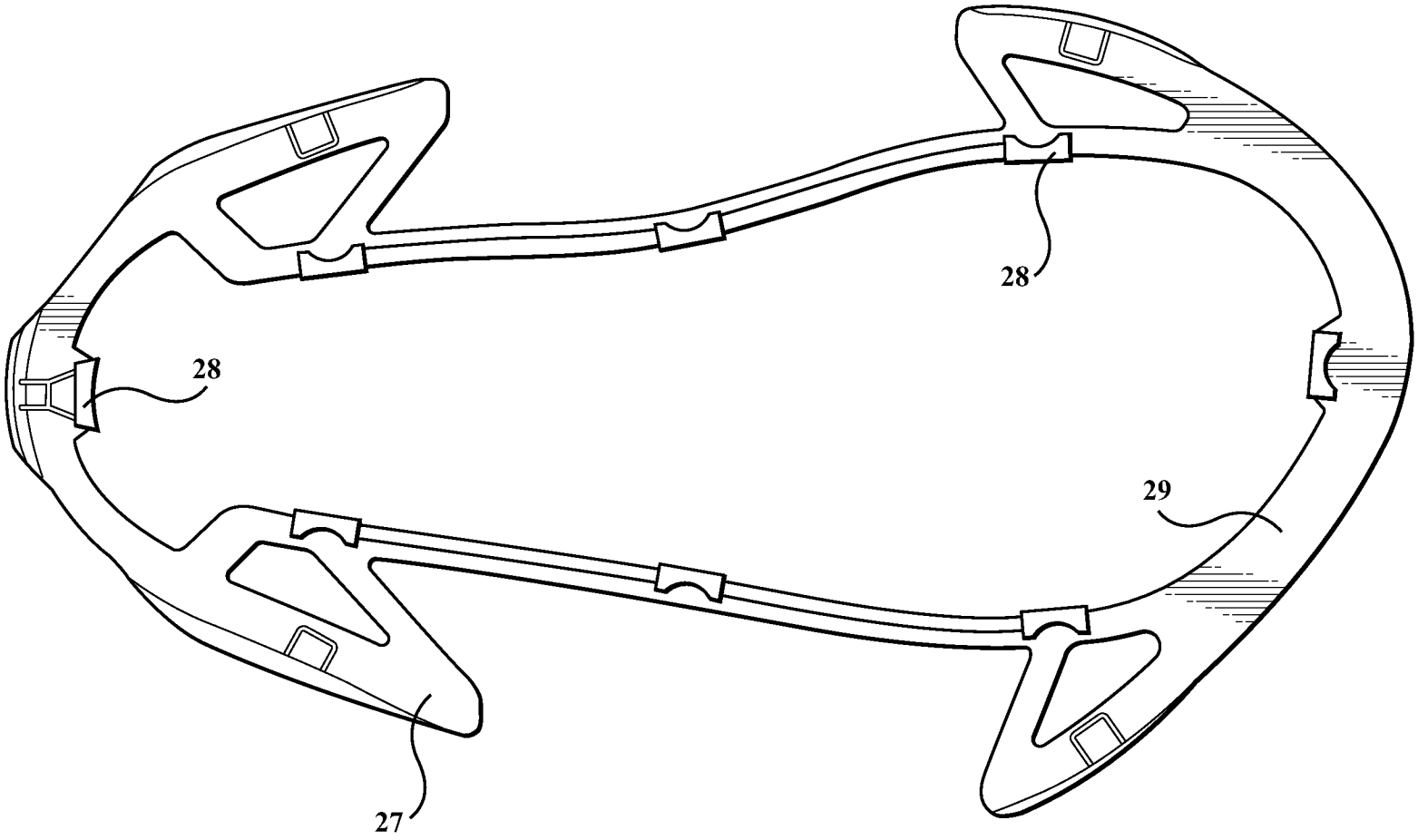
FIG. 7 is a top view of the press fit gasket.

In some embodiments, a press fit gasket 27 may be added to the bottom of the base plate 20 of the inventive wakeboard binding 9. FIG. 7 shows a press fit gasket 27 used in a preferred embodiment of the binding 9. This gasket 27 reduces rubbing between the binding 9 and the wakeboard 10 when the binding 9 is in use, allows the binding 9 to be more flexible and responsive while in use, and dampens vibration on the board's top surface. Additionally, this part adds more pressure to the heel and toe via high points in these locations that pre-load the base plate as it is fastened to the board. In embodiments utilizing a press fit gasket 27, the gasket can be easily removed and replaced due to the way it is fitted to the base plate 2. This offers the consumer possible material, density, and color modifications. In the past, base gaskets have been die stamped rubber or foam materials that need to be permanently adhered to the bottom of the base plate 2. In embodiments utilizing a press fit gasket 27, the gasket 27 may be directly connected to the base plate 2 without additional adhesives, stitching, or fasteners. To facilitate this connection the press fit gasket 27 is configured to interlock with the base plate 2. This may be accomplished using eyelets, posts, pins, pegs, channels, hooks, tongues, grooves, snaps, latches, a combination thereof or any other known interlocking system suitable for creating a secure connection between the press fit gasket 27 and the base plate 2.

In the preferred embodiment, a plurality of pegs 28 are positioned around the periphery of the press fit gasket 27. Three pegs 28 are place along the instep, three along the outstep, three in the toe portion, and three are placed in the heel portion of the press fit gasket 27. The pegs 28 are positioned generally perpendicular to the bottom of press fit gasket 29 and shaped to press into holes 30 similarly positioned in the base plate 2.

The invention claimed is:

1. A wakeboard binding comprising:

an upper comprising a skeleton frame and at least one other component stitched to the skeleton frame;

a base plate;

a means for connecting the upper to the base plate comprising interlocking a portion of the skeleton frame directly with a portion of the base plate at least two locations along the medial portion and at least two locations along the lateral portion of the base plate; and a means for connecting the base plate to the wakeboard.

2. The wakeboard binding of claim 1, wherein the skeleton frame comprises a single molded structure.

3. The wakeboard binding of claim 1, wherein the base plate further comprises a wall with at least three attachment pegs.

4. The wakeboard binding of claim 3, wherein a portion of the skeleton frame that wraps underneath the bottom of the base plate.

5. The wakeboard binding of claim 3, wherein the means for directly connecting the upper to the base plate includes a plurality of eyelets positioned around the lower periphery of the skeleton frame and a plurality of attachment pegs molded into the side wall which facilitate the connection between the base plate and the eyelets in the skeleton frame.

6. The wakeboard binding of claim 1, wherein the means for directly connecting the upper to the base plate further comprises:

at least one lock beam that is a separate structure from the skeleton frame and that snaps into the base plate at least along.

7. The wakeboard binding of claim 6, wherein the means for directly connecting the upper to the base plate includes at least one lock beam that sandwiches a portion of the skeleton frame between the lock beam and the base plate.

8. The wakeboard binding of claim 7, wherein the means for directly connecting the upper to the base plate additionally comprises lock beams positioned along both the lateral and medial portions of the base plate.

9. The wakeboard binding of claim 7, wherein the lock beam is configured with grooves that receive attachment pegs on the skeleton frame and base plate.

10. The wakeboard binding of claim 1, further comprising:

a press fit gasket; and a means for attaching the press fit gasket to the base plate comprising pegs molded into the press fit gasket that snap into holes in the base plate.

11. The wakeboard binding of claim 10, wherein a plurality of pegs are positioned around the periphery of the press fit gasket.

12. The wakeboard binding of claim 1, wherein the means for connecting the base plate to the wakeboard comprises two connection flanges located substantially at the medial portion and lateral portion of the base plate.

13. A method of constructing the binding assembly of claim 1, wherein the binding having the upper mounted to a surface of the wakeboard comprising directly connecting the skeleton frame to the base plate and securing the base plate to the wakeboard, such that the upper is attached to the wakeboard by the attachment of the base plate to the wakeboard.

14. The method of claim 13, further comprising additionally securing the connection between the upper and the base plate with lock beams with grooves that receive attachment pegs on the skeleton frame and base plate.

15. The method of claim 14, further comprising attaching a toe cap to the upper and directly connecting the toe cap to the base plate.

16. The method of claim 15, further comprising directly connecting a press fit gasket to the bottom of the base plate with a plurality of pegs positioned around the periphery of the press fit gasket.

* * * * *